US006915536B2

(12) United States Patent
Chen

(10) Patent No.: US 6,915,536 B2
(45) Date of Patent: Jul. 12, 2005

(54) INCLINATION ADJUSTING MEANS FOR BACKREST OF BASSINET

(75) Inventor: Shun-Min Chen, Taipei Hsien (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 0 days.

(21) Appl. No.: 10/668,639

(22) Filed: Sep. 23, 2003

(65) Prior Publication Data

US 2005/0060805 A1 Mar. 24, 2005

(51) Int. Cl.[7] ..... A27C 20/04
(52) U.S. Cl. ..... 5/93.1; 5/633; 5/634
(58) Field of Search ..... 5/93.1, 614, 632–634; 297/377, 463.1

(56) References Cited

U.S. PATENT DOCUMENTS

| | | | | | |
|---|---|---|---|---|---|
| 513,246 | A | * | 1/1894 | Parliaman | 297/172 |
| 841,008 | A | * | 1/1907 | Frickey | 5/634 |
| 2,663,029 | A | * | 12/1953 | Whitley et al. | 5/634 |
| 6,021,534 | A | * | 2/2000 | Koch | 5/606 |

* cited by examiner

*Primary Examiner*—Heather Shackelford
*Assistant Examiner*—Fredrick Conley

(74) *Attorney, Agent, or Firm*—Scully, Scott, Murphy & Presser

(57) ABSTRACT

An inclination adjusting means for the backrest of a bassinet is provided, which comprises a bedplate, a backrest, a supporting rod and a band. The bedplate and the backrest are integrally formed in one component and are connected together via plastic hinges. The supporting rod is pivotally connected to the bedplate with a centrally-protruding portion passing through the sliding slot of the backrest. The band is tied in the middle of the centrally-protruding portion of the supporting rod and the free end of the band is suspended and drooped out of the backrest so that a user can easily draw out the band from the rear of the backrest.

When a user intends to raise the backrest, he/she can lift the backrest with his finger passing through a semicircular hole provided on the rear portion of the backrest so that the protruding portion of the supporting rod 3 can slide to the lowest point along a slopping slot. Then, when the user releases his finger, the supporting rod will be directed to engage in the front portion of the sliding slot due to its weight. According, the inclination of the backrest is well defined by the supporting rod. When the user intends to level the backrest, he only needs to hold the backrest with his finger hooking the semicircular hole on the backrest and draw the band toward the rear of the backrest with the other hand so that the backrest enters the front portion of the slopping slot to complete the leveling of the backrest.

18 Claims, 5 Drawing Sheets

INCLINATION ADJUSTING MEANS FOR BACKREST OF BASSINET

FIELD OF INVENTION

The present invention relates to an improved bassinet and more particularly, to an inclination adjusting means for the backrest of a bassinet in which the inclination angle of the backrest relative to the horizontal plane can be easily adjusted.

BACKGROUND OF THE INVENTION

Many kinds of bassinet structures (for example, as shown in FIG. 1) are already well-known, on which a baby can lie and be taken care by his parents or babysitter. However, among the existing bassinet structures, the bed portion of the bassinet is at most shaped as a single bedplate without any means for adjusting the inclination of the backrest. As a result, in view of the need that a baby or infant has to be nursed per three to four hours, the parents or babysitter should hold the baby in arms out of the bassinet and find another suitable place when nursing. Therefore, it would be very convenient if the angle of the bed portion of the bassinet relative to the horizontal plane can be adjusted such that the back of the baby can be raised to an angle suitable for sucking.

SUMMARY OF THE INVENTION

In view of the above drawbacks of conventional bassinets, the present invention is achieved by the diligence and experience of the applicant. The object of this invention is to provide an improved bassinet provided with an inclination adjusting means. Further, it is very convenient to operate this invention for its simple structure.

According to one aspect of this invention, an inclination adjusting means for the backrest of a bassinet is provided, which mainly comprises a bedplate, a backrest, a supporting rod and a band. The bedplate and the backrest are integrally formed in one component and are connected together via plastic hinges. The underside of the backrest is provided with a sliding slot. One end of the supporting rod is pivotally connected to the bedplate and the other end is slidably inserted through the sliding slot. With the sliding of the supporting rod between at least two positions in the sliding slot, the supporting rod can be used to adjust the angle of the backrest relative to the bedplate. The band is tied in the middle of a protruding portion of the supporting rod and the free end of the band is suspended and drooped out of the backrest so that a user can easily draw the band from the rear of the backrest According to the inclination adjusting means for the backrest of the bassinet, the supporting rod can be moved between a flat position and an inclined position. When raising the backrest, the user can lift the backrest with his finger passing through a semicircular hole provided on the rear portion of the backrest so that the supporting rod can slide to the lowest point along a slopping slot. Then, the user releases his finger and the supporting rod will be directed to the front portion of the sliding slot due to its weight. According, the inclination of the backrest is well defined by the supporting rod.

When the user intends to level the backrest, he only needs to draw the band toward the rear of the backrest so that the supporting rod disengages from the sliding slot. Then, the supporting slot will enter the front portion of the slopping slot and thus the leveling of the backrest is completed.

With the above arrangement, the inclination adjusting means for the backrest of the bassinet according to this invention has the following advantage that a user can still nurse the baby on the bassinet with the backrest inclined. He does not need to hold the baby in arms to another place. After finishing the nursing, in order to level the backrest, the user only needs to hold the backrest with his finger hooking the semicircular hole on the backrest and draw the band toward the rear of the backrest with the other hand. Therefore, it is very convenient for the user to carry out the inclination adjusting and the leveling of the backrest.

BRIEF DESCRIPTION OF THE DRAWINGS

The structure, features and functions of this invention will be described in detail with reference to the following description together with the accompany drawings, in which.

DETAILED DESCRIPTION OF THE PREFERRED EMBODIMENT

Figure 1:
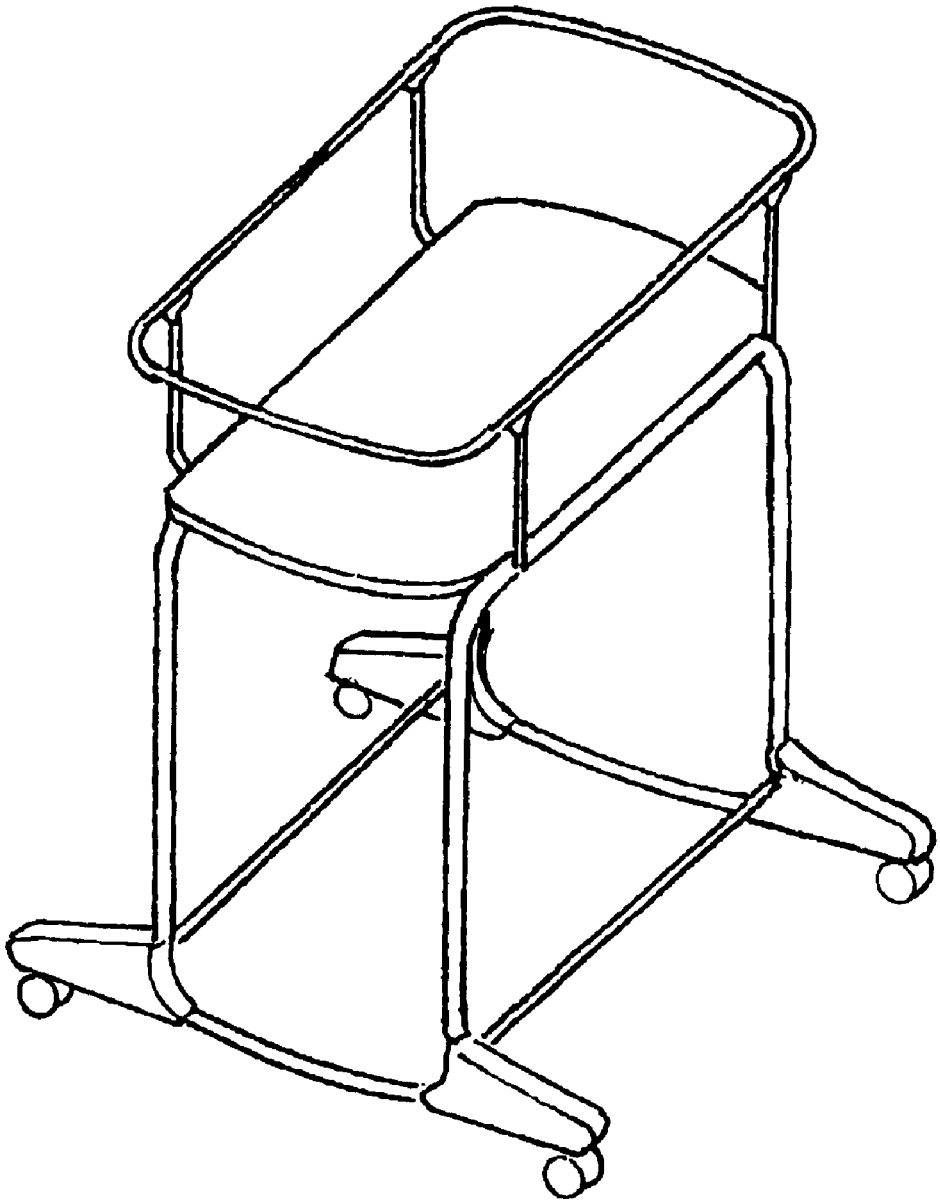
FIG. 1 is a perspective view showing a conventional bedplate structure of the bassinet without any inclination adjusting means for backrest.
Figure 2:
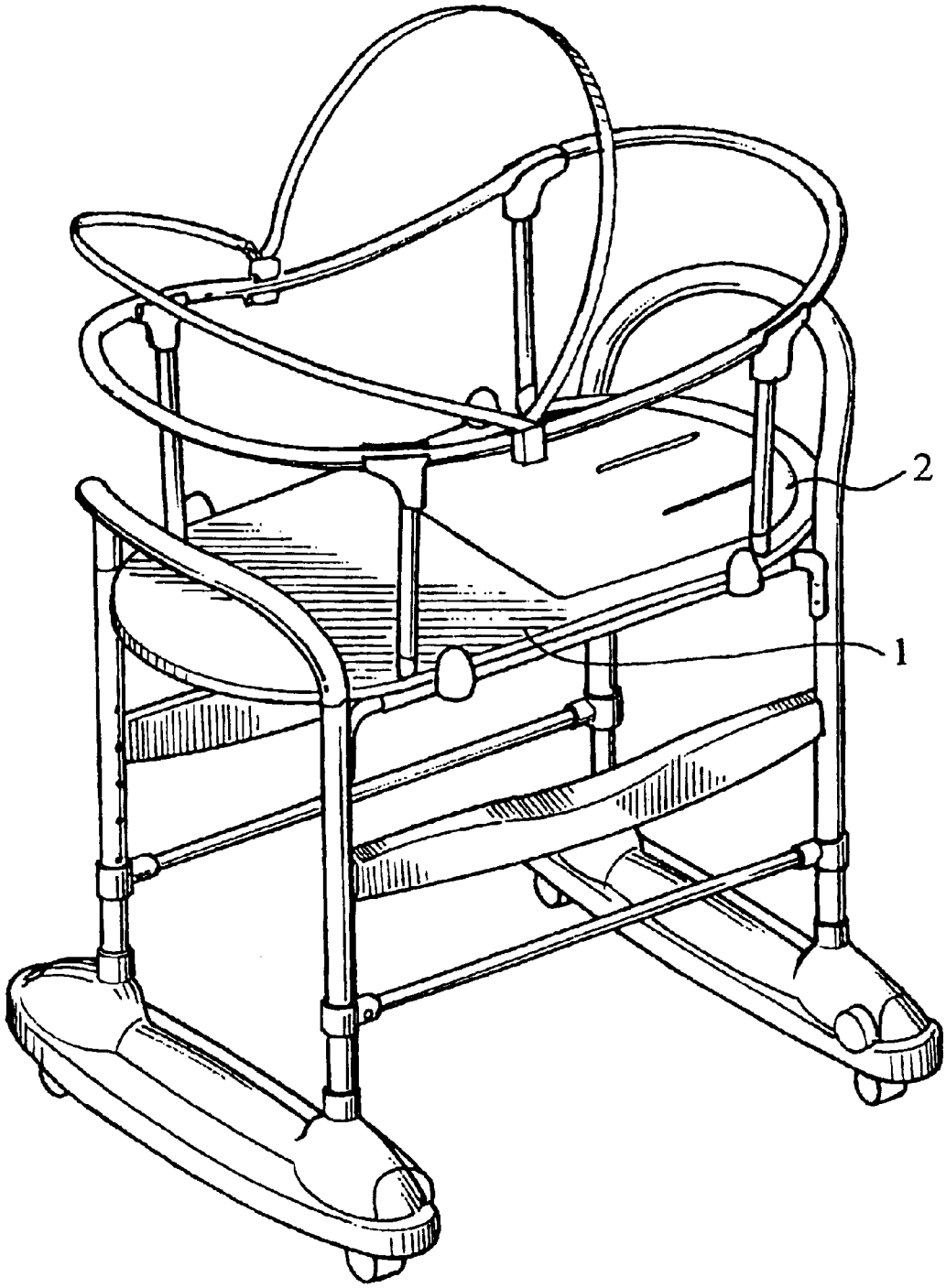
FIG. 2 is a perspective view showing the inclination adjusting means for the backrest of a bassinet of this invention is at the flat position.
Figure 3:
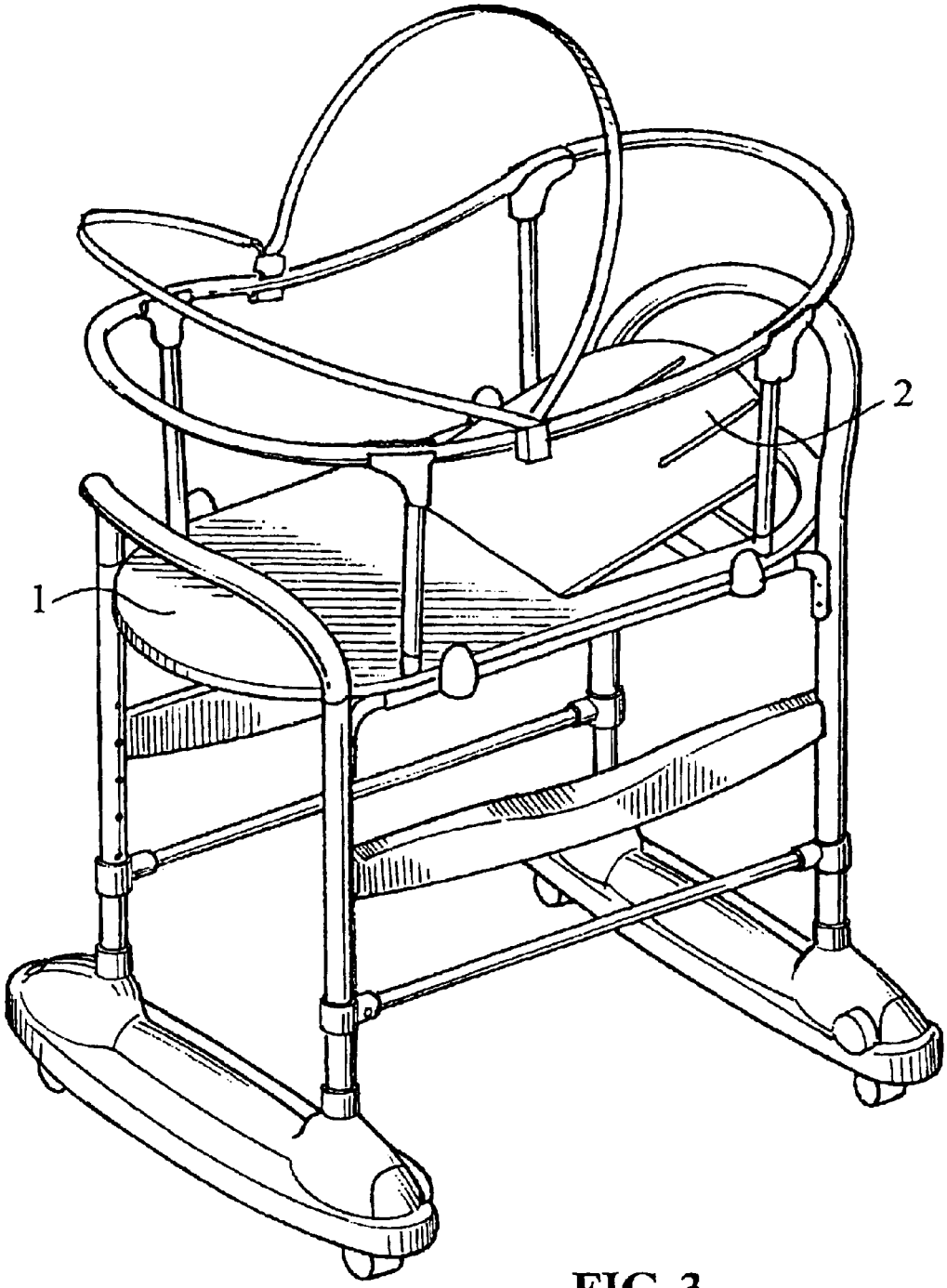
FIG. 3 is a perspective view showing the inclination adjusting means for the backrest of a bassinet of this invention is at the inclined position.
Figure 4:
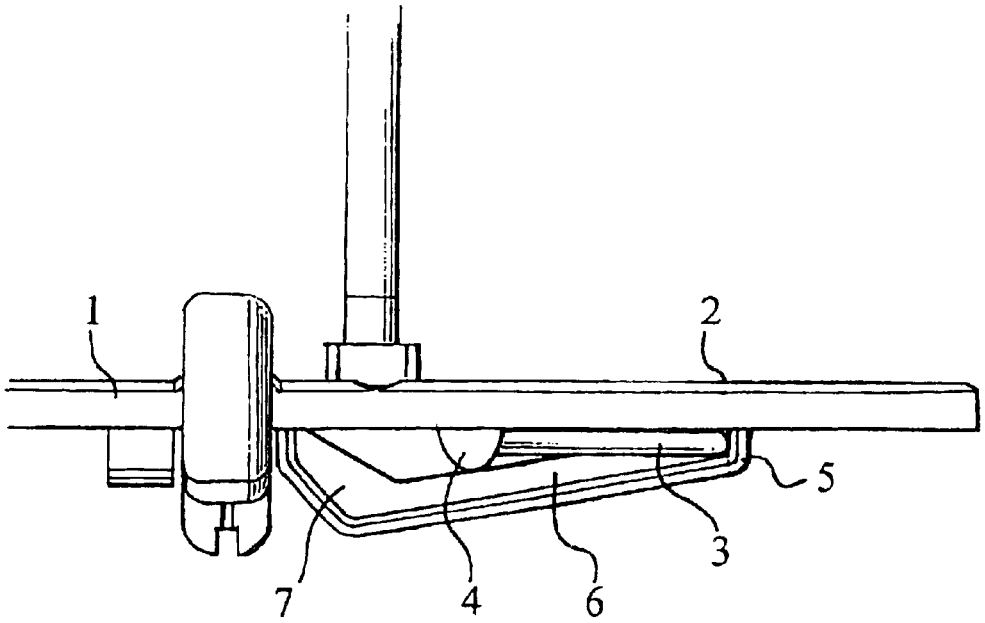
FIG. 4 is a partial side view showing the posture of the supporting rod when the inclination adjusting means for the backrest of a bassinet of this invention is at the flat position.
Figure 5:
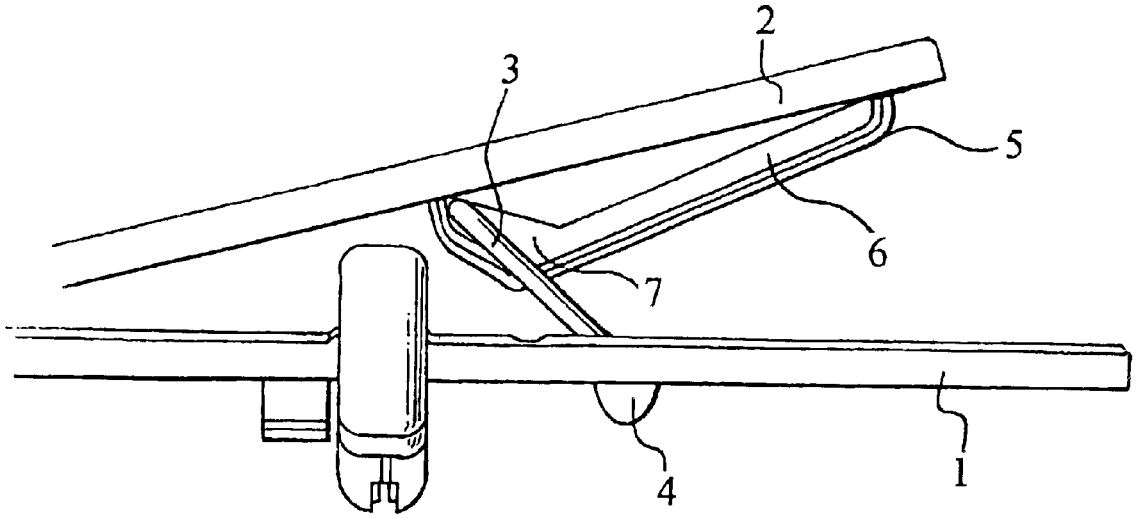
FIG. 5 is a partial side view showing the posture of the supporting rod when the inclination adjusting means for the backrest of a bassinet of this invention is at the inclined position.
Figure 6:
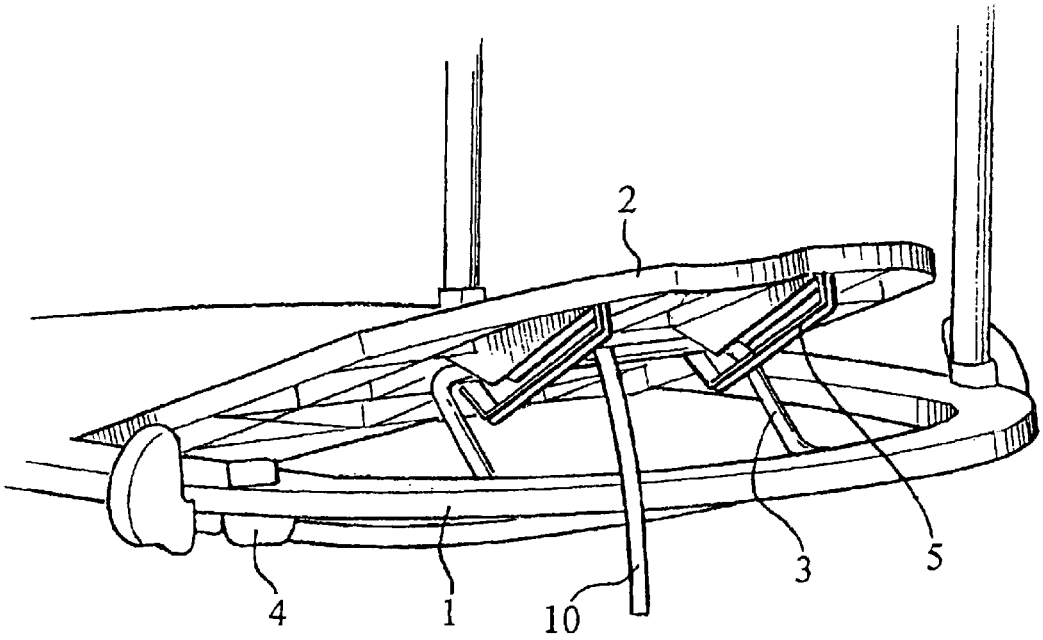
FIG. 6 is a partial perspective view showing the posture of the supporting rod when the inclination adjusting means for the backrest of a bassinet of this invention is at the inclined position.

This invention will be described with reference to the accompany drawings. The inclination adjusting means for the backrest of a bassinet according to this invention mainly comprises a bedplate 1, a backrest 2, a supporting rod 3 and a band 10. The bedplate 1 and the backrest 2 are integrally formed in one component and are connected together via plastic hinges. As shown in FIG. 6, in this embodiment, the backrest 2 is cut from a front-half portion of the bedplate 1 and thus the backrest 2 is flush with the bedplate 1 when the backrest 2 is at a flat position. The rear portion of the backrest 2 is provided with a semicircular hole for hooking upwardly the backrest 2 by the user's finger. The underside of the backrest 2 is integrally formed a pair of triangular mountings each provided with a longer slopping slot 6 and a shorter sliding slot 7 so that the supporting rod 3 can be moved between a flat position and an inclined position.

Figure 7:
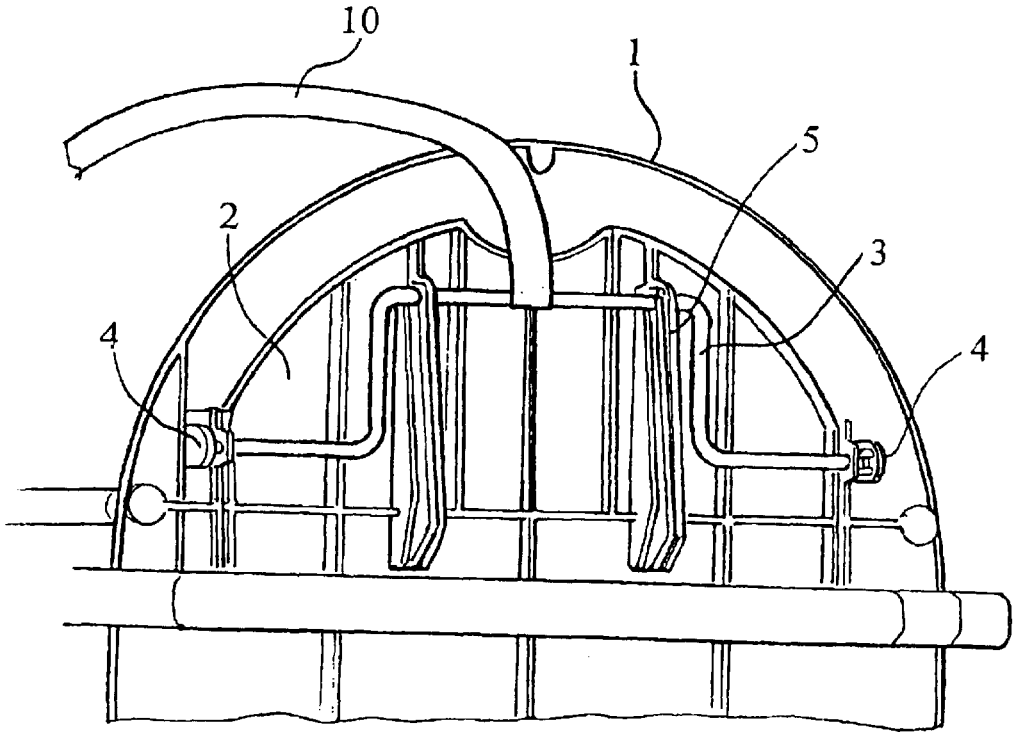
FIG. 7 is a bottom view showing the posture of the supporting rod when the inclination adjusting means for the backrest of a bassinet of this invention is at the flat position.

With reference to FIGS. 6 and 7, the supporting rod 3 is bent into a ⊓-shaped structure. Both ends are extended and pivotally connected to the bedplate 1 via two supporting rod pivots 4. The centrally-protruding portion of the supporting rod 3 passes through the slopping slot 6 of the triangular mounting 5 on the underside of the backrest 2. The band 10 is tied in the middle of the centrally-protruding portion of the supporting rod 3 and the free end of the band 10 is suspended and drooped out of the backrest 2 so that a user can easily draw the band 10 from the rear of the backrest 2.

Next, the operation of the inclination adjusting means for the backrest of a bassinet according to this invention will be described. When a user intends to raise the backrest 2, he can lift the backrest 2 with his finger passing through a semicircular hole provided on the rear portion of the backrest 2. As a result, the supporting rod 3 is brought to pivot by the triangular mounting 5 of the backrest 2 so that the protruding portion of the supporting rod 3 can slide to the lowest point along a slopping slot 6. Then, when the user releases his finger, the supporting rod 3 will be directed to engage in the front portion of the sliding slot due to its weight. According, the inclination of the backrest 3 is well defined by the supporting rod 3.

With the above arrangement, the inclination adjusting means for the backrest of the bassinet according to this invention has the following advantage that a user can still nurse the baby lying on the bassinet with the backrest thereof inclined. He does not need to hold the baby in arms to another place. After finishing the nursing, in order to level the backrest, the user only needs to hold the backrest with his finger hooking the semicircular hole on the backrest, draw the band toward the rear of the backrest with the other hand and slowly puts down the backrest. Therefore, it is very convenient for the user to carry out the inclination adjusting and the leveling of the backrest. Further, the structure of this invention is very simple and thus has low influence on the cost and price. Therefore, it goes without saying that customers will prefer this invention to the conventional bassinet in view of function and price.

While this invention has been described by the above embodiments, it should be understood that this invention is not limited to this. Various modifications in material or structure can be carried out by those skilled in this art in view of the teaching of this invention. Therefore, as long as not departing from the spirit of this invention, such simple modification or equivalent change still falls in the scope of this invention defined by the appended claims.

List of Reference Numerals of Primary Elements

1 bedplate
2 backrest
3 supporting rod
4 supporting rod pivot
5 triangular mounting
6 slopping slot
7 sliding slot
10 band

What is claimed is:

1. An inclination adjusting device for a bassinet, comprising:

a bedplate;

a backrest provided with a sliding slot thereon;

a supporting rod pivotally connected to the bedplate and slidably passing through the sliding slot, wherein the angle of the backrest relative to the bedplate is adjustable by movement of the supporting rod between at least two different positions in the sliding slot; and a band for leveling of the backrest, said band being tied to and suspended from said supporting rod such that drawing said band causes the movement of said supporting rod in the sliding slot.

2. An inclination adjusting device for a bassinet according to claim 1, wherein the backrest and the bedplate are integrally formed into one single component by being pivotally connected to each other.

3. An inclination adjusting device for a bassinet according to claim 1, wherein the backrest is provided with a hole to facilitate the backrest being hooked upwardly by a finger of a user passing through the hole.

4. An inclination adjusting device for a bassinet according to claim 1, wherein the backrest is integrally formed on the underside thereof with at least one mounting, the sliding slot being formed in the at least one mounting, and wherein the sliding slot includes a longer sloping slot and a shorter sliding slot portion such that the supporting rod is movable between a flat position in which the supporting rod is located in the longer sloping slot and an inclined position in which the supporting rod is located in the shorter sliding slot portion.

5. An inclination adjusting device for a bassinet according to claim 4, wherein the supporting rod includes two free ends which are pivotally connected to the bedplate and a central portion passing through the at least one mounting.

6. An inclination adjusting device for a bassinet according to claim 4, wherein the at least one mounting comprises a pair of triangular mountings.

7. An inclination adjusting device for a bassinet, comprising:

a bedplate;

a backrest provided with a sliding slot thereon; and a supporting rod pivotally connected to the bedplate and slidably passing through the sliding slot, wherein the angle of the backrest relative to the bedplate is adjustable by movement of the supporting rod between at least two different positions in the sliding slot;

wherein the backrest and the bedplate are integrally formed in one single component by being pivotally connected to each other; and wherein said backrest is integrally formed on the underside thereof with at least one mounting, said sliding slot being formed in said at least one mounting, and said sliding slot being formed in said at least one mounting, and said sliding slot including a longer sloping slot and a shorter sliding slot portion such that said supporting rod is movable between a flat position in which said supporting rod is located in the longer sloping slot and an inclined position in which said supporting rod is located in the shorter sliding rod portion.

8. An inclination adjusting device for a bassinet according to claim 7, wherein the backrest is provided with a hole to facilitate the backrest being hooked upwardly by a finger of a user passing through the hole.

9. An inclination adjusting device for a bassinet according to claim 7, wherein the supporting rod includes two free ends which are pivotally connected to the bedplate and a central portion passing through the at least one mounting.

10. An inclination adjusting device for a bassinet according to claim 7, wherein the at least one mounting comprises a pair of triangular mountings.

11. An inclination adjusting device for a bassinet, comprising:

a bedplate;

a backrest integrally formed on the underside thereof with at least one mounting provided with a sloping slot and a sliding slot; and a supporting rod pivotally connected to the bedplate and passing through the at least one mounting such that the supporting rod is movable between a flat position in which the supporting rod is located in the sloping slot and an inclined position in which the supporting rod is located in the sliding slot.

12. An inclination adjusting device for a bassinet according to claim 11, wherein the backrest is provided with a hole to facilitate the backrest being hooked upwardly by a finger of a user passing through the hole.

13. An inclination adjusting device for a bassinet according to claim 12, wherein the hole is semicircular in shape.

14. An inclination adjusting device for a bassinet according to claim 11, wherein the at least one mounting comprises a pair of triangular mountings.

15. An inclination adjusting device for a bassinet according to claim 11, wherein the sloping slot is longer than the sliding slot.

16. An inclination adjusting device for a bassinet according to claim 11, wherein the supporting rod includes two free ends which are pivotally connected to the bedplate and a central portion passing through the at least one mounting.

17. An inclination adjusting device for a bassinet according to claim 11, further comprising a band for leveling of the backrest.

18. An inclination adjusting device for a bassinet according to claim 11, wherein the backrest and the bedplate are integrally formed in one single component by being pivotally connected to each other.

* * * * *